US006857868B1

(12) United States Patent
Li et al.

(10) Patent No.: US 6,857,868 B1
(45) Date of Patent: Feb. 22, 2005

(54) BURNER WITH A MODULAR FLAME RETENTION PLATE SYSTEM

(75) Inventors: Ceji Li, Bloomingdale, IL (US); Qin-Lai Yu, Niles, IL (US)

(73) Assignee: Midco International, Inc., Chicago, IL (US)

( * ) Notice: Subject to any disclaimer, the term of this patent is extended or adjusted under 35 U.S.C. 154(b) by 0 days.

(21) Appl. No.: 10/644,499

(22) Filed: Aug. 20, 2003

(51) Int. Cl.[7] ..... F23Q 3/00

(52) U.S. Cl. ..... 431/266; 431/187; 431/278; 431/284

(58) Field of Search ..... 431/265, 266, 431/278, 8, 9, 12, 284, 353, 187, 188, 177, 354, 351, 350; 239/403–405, 505, 536, 520, 553, 554, 555, 561

(56) References Cited

U.S. PATENT DOCUMENTS

| | | | | |
|---|---|---|---|---|
| 4,978,293 A | * | 12/1990 | Ryno | 431/258 |
| 5,494,437 A | | 2/1996 | Kubota et al. | 431/181 |
| 5,863,192 A | | 1/1999 | Motegi | 431/8 |
| 5,899,680 A | | 5/1999 | Motegi | 431/8 |
| 5,934,898 A | | 8/1999 | Fayerman | 431/353 |
| 5,975,887 A | | 11/1999 | Kamal et al. | 431/181 |
| 6,050,809 A | | 4/2000 | Fayerman | 431/114 |
| 6,059,566 A | * | 5/2000 | Cummings, III | 431/353 |
| 6,267,586 B1 | | 7/2001 | Maricic | 431/354 |
| 6,485,293 B1 | | 11/2002 | Li et al. | 431/266 |
| 6,508,645 B1 | * | 1/2003 | George | 431/266 |
| 6,544,031 B2 | | 4/2003 | Li et al. | 431/266 |

FOREIGN PATENT DOCUMENTS

| | | | |
|---|---|---|---|
| GB | 2224824 | * | 5/1990 |

* cited by examiner

*Primary Examiner*—James C. Yeung
(74) *Attorney, Agent, or Firm*—Marshall, Gerstein & Borun LLP

(57) ABSTRACT

A burner assembly includes a generally cylindrical burner tube having a combustion chamber. The burner tube supplies combustion air and combustion gas to the combustion chamber. A burner head assembly is disposed in the burner tube upstream of the combustion chamber. The burner head assembly includes a plurality of flame retention plates having a plurality of changeable flame retention plates removably mounted thereto. The flame retention plates include a base plate, at least one intermediate plate, and a top plate. Each of the base plate, the intermediate plate, and the top pate includes a plurality of combustion air flow and combustion gas flow apertures.

17 Claims, 11 Drawing Sheets

BURNER WITH A MODULAR FLAME RETENTION PLATE SYSTEM

FIELD OF THE DISCLOSURE

The present disclosure generally relates to burners, and more particularly, to a burner with a modular flame retention plate system.

BACKGROUND

Burners which combust gas, such as propane and natural gas, are well known and widely applied. For example, boilers, furnaces, kilns, incinerators, dryers, and food processing equipment all commonly rely upon the heat generated by such combustion for proper operation.

Prior art burner designs have been created to mix a combustible gas with air and provide a spark for the purpose of starting. Extensive attention has been directed to finding proper mixing ratios and to creating apparatus for obtaining such ratios to most efficiently burn the gas while maximizing BTU output.

One known type of burner includes a substantially cylindrical housing provided with an inlet and an outlet. A motor connected to a blower or a fan wheel is typically connected to the inlet to direct air needed for combustion therethrough. A gas supply conduit typically enters the inlet end of the housing as well, and terminates in a gas nozzle short of the housing outlet end. The area of the housing downstream of the nozzle defines a combustion chamber. An ignition source, such as a spark plug or rod, is positioned proximate the gas nozzle and can be energized as needed.

In order to generate a desired airflow through the housing to the combustion chamber to obtain the desired BTU output and flame shape, various flame retention or nozzle plates have been created. Such plates are typically provided transverse to the longitudinal axis of the housing, and are positioned slightly upstream of the nozzle. The plates typically include various aperture designs to direct forced air therethrough. Additionally, the airflow velocity through the housing is typically controlled by a damper. Accordingly, the various aperture designs of the plates in combination with the control of airflow with the damper create desired characteristics in the resulting flame.

The airflow characteristics influence BTU output, flame stability, CO and $NO_x$ emissions. BTU output is a measure of the strength of the flame and its resulting heat output, and is a function of, among other things, the amounts of air and gas combined and the ratio at which they are combined. Flame stability relates to the maintainability and controllability of the flame. If the gas/air ratio becomes too rich or too lean, the flame can be lost or can burn inefficiently. CO and $NO_x$ emission control is critical in complying with various environmental regulations. If the flame is not suitably confined, shaped, and directed, all three of the foregoing characteristics will be adversely affected.

SUMMARY

A burner assembly includes a generally cylindrical burner tube having an end portion defining a combustion chamber. The burner tube supplies combustion air to the combustion chamber. A gas supply conduit disposed inside the burner tube supplies combustion gas to the combustion chamber. The burner assembly further includes a burner head assembly disposed in the burner tube upstream of the combustion chamber. The burner head assembly includes a plurality of name retention plates having a plurality of changeable flame retention plates removably mounted thereto.

A modular flame retention plate system for use in a burner with a combustion chamber includes a base plate disposed upstream of the combustion chamber, at least one intermediate plate mounted on and downstream of the base plate, and a top plate mounted on and downstream of the intermediate plate. Each of the base plate, the intermediate plate, and the top plate includes a plurality of combustion air flow and combustion gas flow apertures.

A method of controlling delivery of combustion air and combustion gas into a combustion chamber of a burner includes providing a plurality of interaction chambers upstream of the combustion chamber. Each interaction chamber is bound by a flame retention base plate, a flame retention intermediate plate, and a flame retention top plate. The intermediate plate is disposed between the base plate and the top plate. The shape of the interaction chamber is generally defined by the flame intermediate plate. The method further includes providing combustion air to each interaction chamber through a plurality of air flow apertures disposed in the base plate, and distributing combustion gas into each of the interaction chambers by a hub and a plurality of spokes of the intermediate plate. The spoke extend outward from the hub. The hub and the spokes receive combustion gas from at least one gas aperture disposed in the base plate. The method also includes delivering combustion air and combustion gas from each interaction chamber into the combustion chamber and through plurality of gas and air flow apertures disposed in the top plate.

Figure 1:
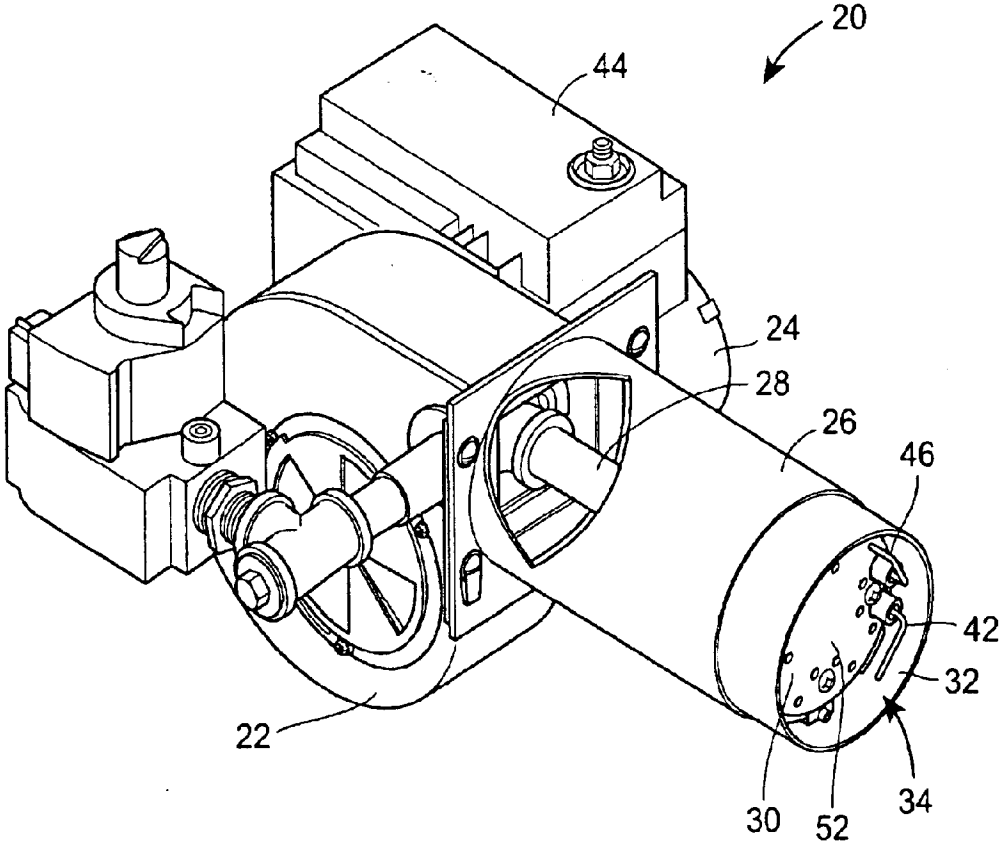
FIG. 1 is a perspective view of a burner with a modular flame retention plate system constructed in accordance with teachings of the present disclosure.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION

Referring now to the drawings and with specific reference to FIG. 1, a burner assembly having a modular flame retention plate system constructed in accordance with the teachings of the present disclosure is generally depicted by reference numeral 20. The burner 20 includes a blower housing 22 in which a blower fan (not shown) is adapted to rotate. The fan is powered by a motor 24. An air flow created by the blower fan is directed through a burner tube 26, which is shown to be substantially cylindrical in shape. A gas supply conduit 28 that is concentrically housed in the burner tube 26 supplies combustible gas to a burner head assembly 30, which is also disposed in the burner tube 26. The burner head assembly 30 is attached to the gas supply conduit 28 and is disposed near an outlet 32 of the burner tube 26. Accordingly, combustion gases are delivered to the burner head assembly 30 by the gas supply conduit 28, while combustion air is delivered to the burner head assembly 30 by burner tube 26. The burner 20 is primarily directed to combustion of propane, but is to be understood that other gases, including but not limited to natural gas, can be employed.

A combustion chamber 34 is defined by the space downstream of the outlet 32. Air and gas are mixed and ignited in the combustion chamber 34 as will be discussed in further detail herein. The resulting flame (not shown) is directed outwardly through the outlet 32 of the burner tube 26. The outlet 32 can be positioned proximate any suitable receiving conduit, heat exchanger, or chamber such as that provided in a boiler, furnace, heat exchanger, kiln or the like, to perform useful work therein.

A flame rod assembly 40 is positioned downstream of the plate system 52 to detect and ensure the presence of a flame. Such flame rod assemblies 40 are conventional and may operate by providing a flame rod 42, which upon being heated by the flame, directs a suitable signal to a controller 44 of the burner 20. The controller 44 may be in communication with a higher level integrated control system (not shown), which may take advantage of the signal to provide an indication to an operator as to whether a flame is present.

An ignition spark rod assembly 46 is also provided in the combustion chamber 34. The ignition spark rod assembly 46 provides initial ignition such that upon actuation of the motor 24, and flow of gas through the gas supply conduit 28 and the burner head assembly 30, overall ignition of the burner 20 is insured. Ignition and continuous operation of the burner 20 are verified by the flame rod 42 and the controller 44.

Figure 2:
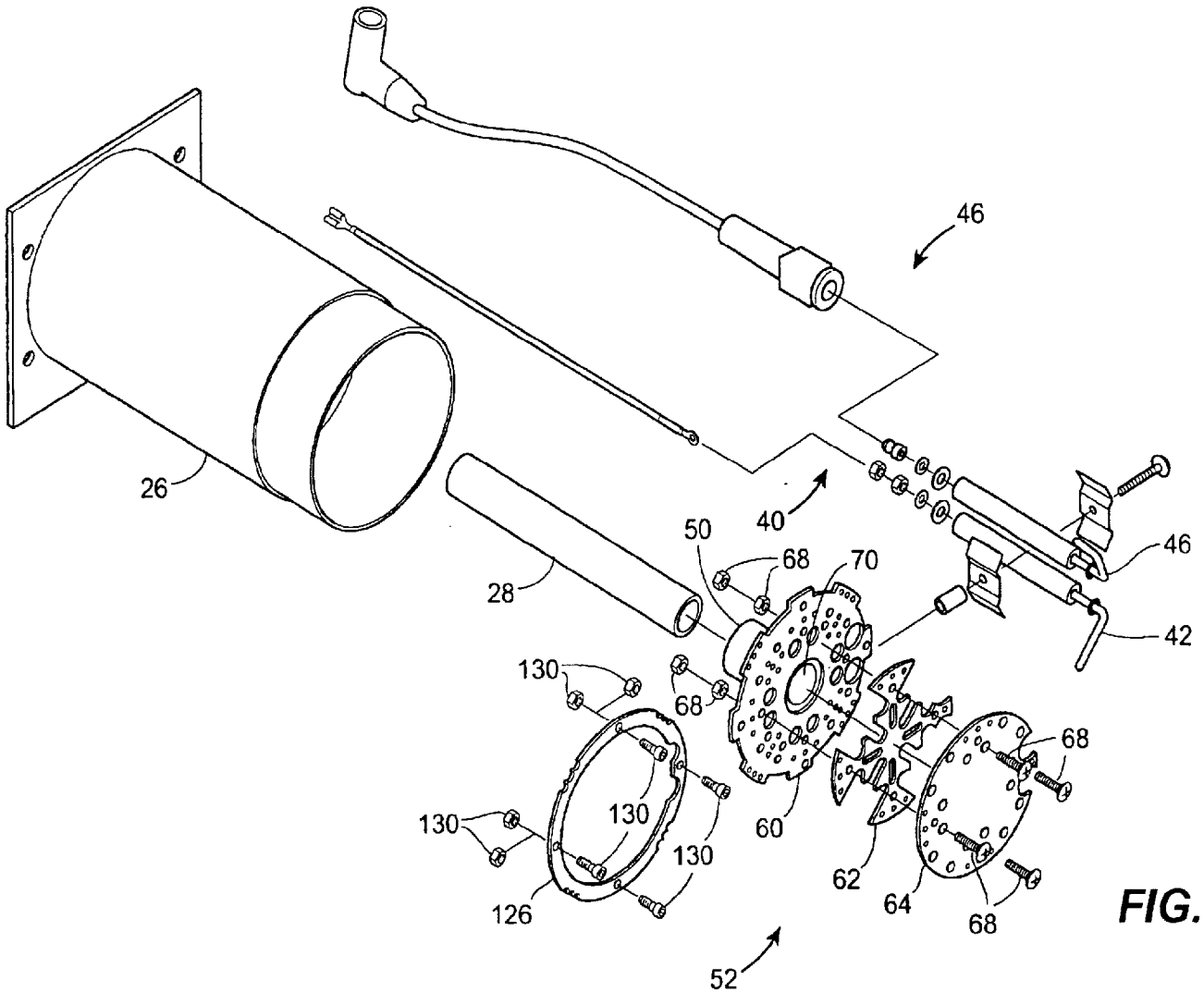
FIG. 2 is a perspective exploded view of a burner head assembly of the burner of FIG. 1.

Turning now to FIG. 2, the burner head assembly 30 includes a gas supply port 50 and a modular flame retention plate system 52 ("plate system 52"). The gas supply port 50 is generally tubular and is attached to the gas supply conduit 28, as by threaded attachment or the like. The gas supply port 50 receives combustion gas from the gas supply conduit 28 and delivers the combustion gas to the retention plate system 52. The attachment of the gas supply port 50 to the gas supply conduit 28 is sealed so as to prevent combustion gas from mixing with the combustion air upstream of the plate system 52. The gas supply port 50 includes internal threading that engages corresponding threads on the exterior of the gas supply conduit 28. Thus, the burner head assembly 30 can be securely screwed onto the gas supply conduit 28. One of ordinary skill in the art will appreciate, however, other numerous well known methods by which the gas supply port 50 and the gas supply conduit 28 can be sealably attached together.

The retention plate system 52 is oriented transverse to the longitudinal axis (not shown) of the burner tube 26. Referring now to FIGS. 2–5, an exemplary retention plate system 52 will be shown and described to include a base plate 60, at least one intermediate plate 62, and a top plate 64, both of which are mounted on the base plate 60. It is to be understood that the specific base plate 60, intermediate plate 62 and top plate 64 depicted in FIGS. 2–5 are by way of example only. A more detailed embodiment is described later herein with reference to FIGS. 6–12.

The base plate 60, the intermediate plate 62, and the top plate 64 include a plurality of mounting apertures 66, which can be aligned to receive fasteners 68 for secure mounting of the intermediate plate 62 and the top plate 64 to each other and to the base plate 60. As will become apparent in the following, the plate system 52 can include more than one intermediate plate 62, which may be necessary to attain certain desired burn characteristics. Accordingly, as many intermediate plates as desired can be mounted between the base plate 60 and the top plate 64 to achieve desired burn characteristics.

The plate system 52 provides controlled mixing of the combustion air and combustion gas prior to combustion. The plate system 52 further provides controlled delivery of combustion air, combustion gas, and a mixture thereof to the combustion chamber 34 to achieve desired combustion characteristics. Accordingly, the plate system 52 receives combustion air from the burner tube 26 and combustion gas from the gas supply port 50, provides a controlled and desired mixing of the received gases, and controllably delivers combustion air, combustion gas, and/or a mixture thereof to the combustion chamber 34.

Figure 3:
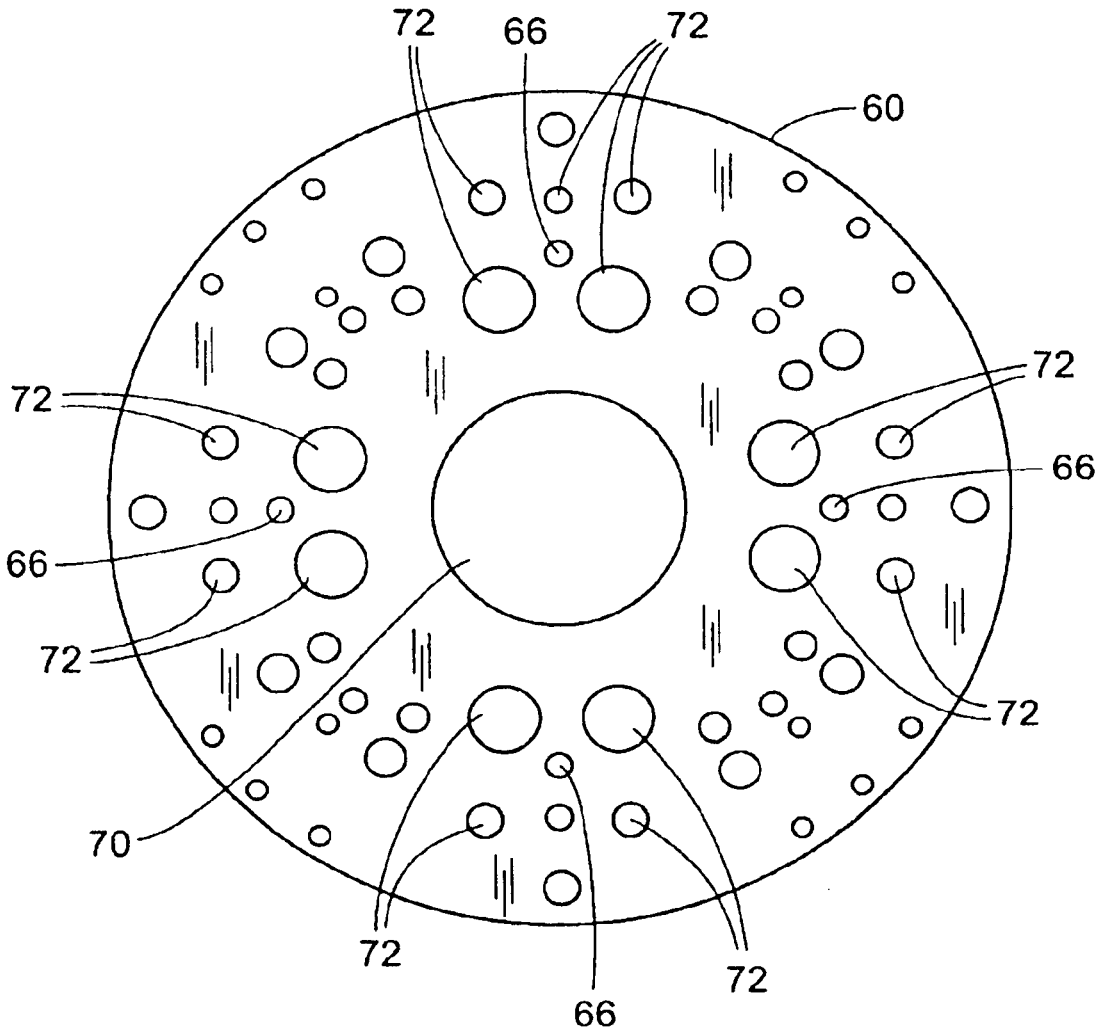
FIG. 3 is top view of an exemplary base plate of a modular flame retention plate system generally constructed in accordance with the teachings of the present disclosure.

Referring to FIG. 3, the base plate 60 is generally circular and has a diameter that is slightly smaller than the internal cross sectional diameter of the burner tube 26. Accordingly, when the gas supply port 50 is attached to the gas supply conduit 28, the base plate 60 substantially occupies the cross section of the burner tube 26. The base plate 60 is attached to the gas supply port 50 such that a center aperture 70 of the base plate 60 receives combustion gas from the gas supply port 50. The base plate 60 also includes a plurality of air flow apertures 72 that allow the combustion air in the burner tube 26 to flow through the base plate 60. One of ordinary skill in the art will readily appreciate that flow characteristics of the combustion air downstream of the base plate 60 depend on the number of the air flow apertures 72, the size of each air flow aperture 72, and the position of each or groups of the air flow apertures 72 on the base plate 60. Accordingly, any desired combustion air flow downstream of the base plate 60 can be achieved.

Figure 4:
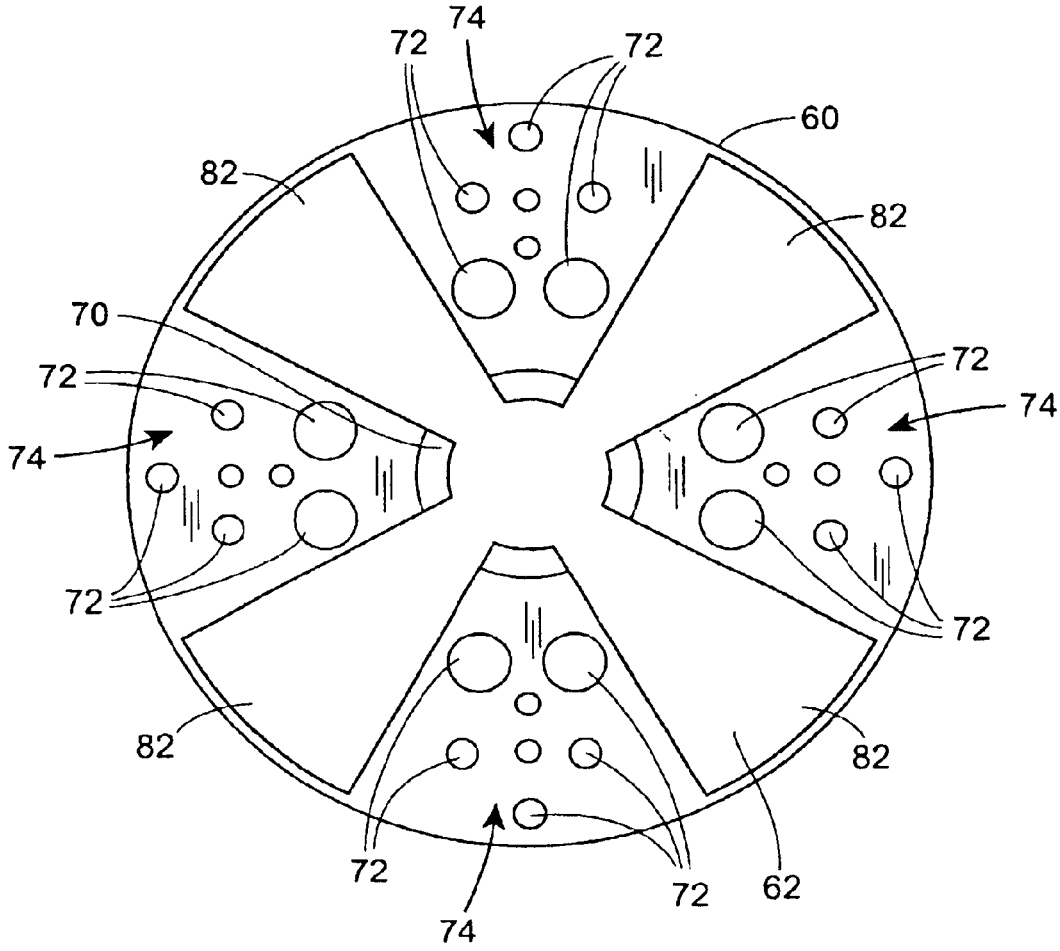
FIG. 4 is a top view of an exemplary intermediate plate of a modular retention plate system generally constructed in accordance with the teachings of the present disclosure, shown mounted on the base plate of FIG. 3.

Referring to FIG. 4, the base plate 60 delivers combustion air to one or more interaction chambers 74 in the retention plate system 52. Each interaction chamber 74 is defined by a volume bounded by the base plate 60, the intermediate plate 62, and the top plate 64. Furthermore, because the intermediate plate 62 is disposed between the base plate 60 and the top plate 64, it generally defines the shape of each interaction chamber 74. The intermediate plate 62 can be shaped and sized to control the delivery of combustion gas to the interaction chambers 74 and control the mixing characteristics of the combustion air with the combustion gas in the interaction chambers 74.

The intermediate plate 62 includes a center portion, which will be referred to in the following as the hub 80, and a plurality of spokes 82 that extend radially outward from the hub 80. When the intermediate plate 62 is mounted on the base plate 60, the hub 80 partially covers the center aperture 70 of the base plate 60. Furthermore, each spoke 82 partially covers the center aperture 70 and extends radially outward from the hub 80. The angular space between each pair of adjacent spokes 82 defines each of the interaction chambers 74. The hub 80 provides controlled radial distribution of the combustion gas from the center aperture 70 of the base plate 60 to each interaction chamber 74. The shape of each spoke 82 can affect the distribution characteristics of combustion gas in each interaction chamber 74. Additionally, the shape of each spoke 82 can affect the mixing characteristics of combustion air and combustion gas in each interaction chamber 74. Accordingly, each spoke 82 can include one or more slots, channels, and/or apertures (not shown) that receive combustion gas from the center aperture 70 and distribute the combustion gas to each interaction chamber 74 with a desired direction, angle, velocity, dispersion pattern, and pressure.

Figure 5:
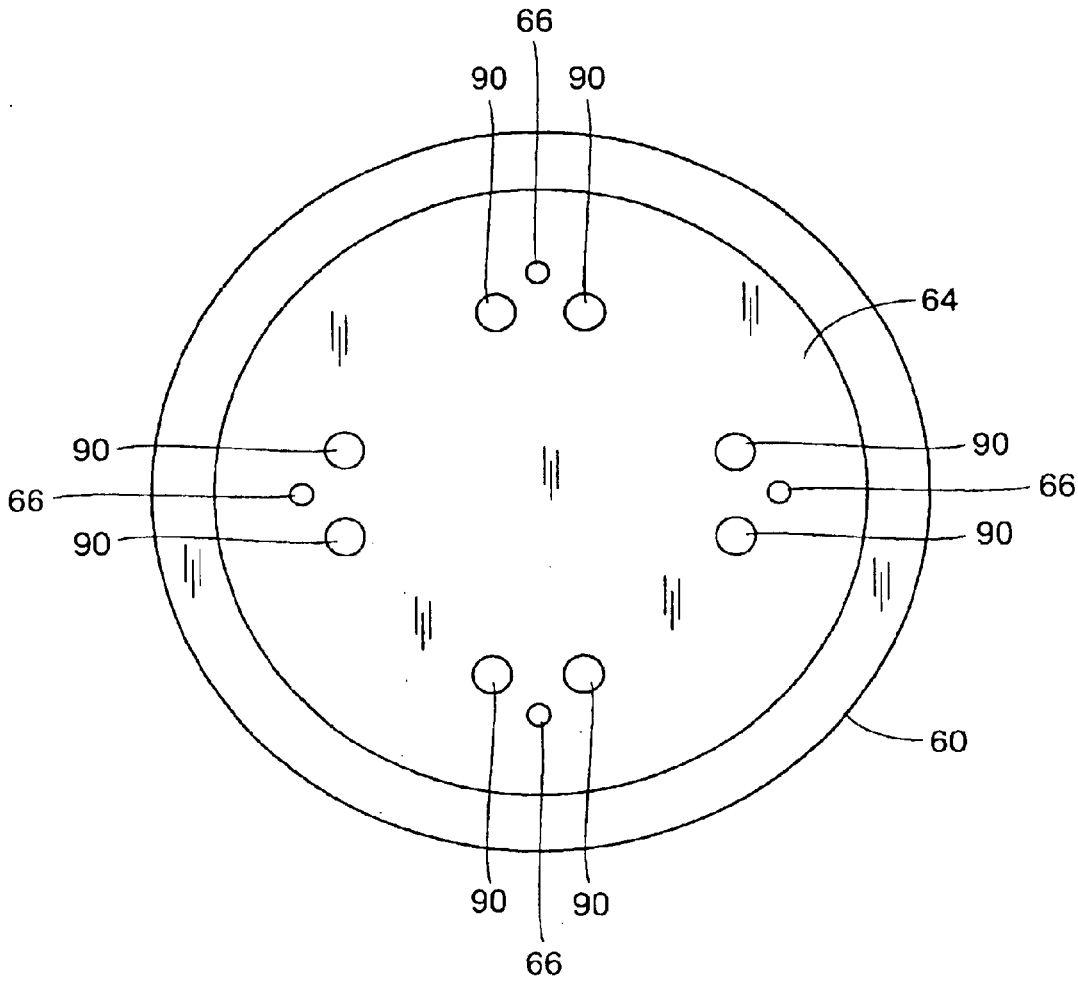
FIG. 5 is a top view of an exemplary top plate of a modular retention plate system generally constructed in accordance with the teachings of the present disclosure, shown mounted on the intermediate plate of FIG. 4.

Referring to FIG. 5, the top plate 64 includes apertures 90 that direct combustion air, combustion gas, and a mixture thereof to the combustion chamber 34. Additionally, the size and shape of the apertures 90, and the distribution of the apertures 90 on the top plate 64, control the velocity, angle, direction, and/or the dispersion pattern of gases into the combustion chamber 34.

The retention plate system 52 can direct combustion gas, combustion air, and/or a mixture thereof to any location in the combustion chamber 34 with any desired direction, angle, velocity, dispersion pattern, and pressure. To only provide combustion gas to the combustion chamber 34, the hub 80 may include a number of apertures (not shown) that align with corresponding apertures (not shown) on the intermediate plate 62 and the top plate 64. Accordingly, combustion gas can be directly provided to the combustion chamber 34 from the center aperture 70 of the base plate 60 through the intermediate plate 62 and the top plate 64. To only provide combustion air to the combustion chamber 34, each spoke 82 can include one or more apertures (not shown) that align with corresponding air flow apertures 72 of the base plate 60 and corresponding apertures on the top plate 64 to direct combustion air to the combustion chamber 34. In effect, the combustion air is routed from the burner tube 26 directly to the combustion chamber 34 without being mixed with any combustion gas.

In some burners with high BTU output, the interaction chambers 74 may need to be larger than an interaction chamber provided by having only one intermediate plate 62. Accordingly, in such burners, more than one intermediate plate 62 can be mounted between the base plate 62 and the top plate 64. Furthermore, as one of ordinary skill in the art will readily appreciate, having more than one intermediate plate 62 provides the opportunity to place dissimilar intermediate plates 62 between the base plate 60 and the top plate 64. Having dissimilar intermediate plates 62 in the plate system 52 provides a wide range of gas and air mixing and delivery thereof to the combustion chamber 34 that may not be possible with having only one intermediate plate 62.

The sizes, locations, and group patterns of various apertures on the base plate 60, the intermediate plate 62, and the top plate 64 can affect the flow rate of combustion air, combustion gas, and a mixture thereof in the interaction chambers 74. Furthermore, the sizes, locations, and patterns of various apertures relative to each other affect delivery of combustion air and combustion gas to the combustion chamber 34. For example, misalignment of corresponding apertures when the intermediate plate 62 and the top plate 64 are mounted on the base plate 60 can affect the direction of flow out of the top plate apertures 90 and into the combustion chamber 34. The sizes of the apertures relative to each other can affect the pressure and velocity of the flow in the combustion chamber 34, while the size of corresponding apertures can further affect the shape of the flow in the combustion chamber 34. For example, an aperture on the top plate 64 that corresponds and communicates with smaller apertures on the intermediate plate 62 and the base plate 60 may provide an expanding flow (i.e., the expansion affecting flow pressure) out of the apertures 90 of the top plate 64. Similarly, an aperture on the top plate 64 that corresponds and communicates with larger apertures on the intermediate plate 62 and the base plate 60 may provide a contracting flow. One of ordinary skill in the art will appreciate from the foregoing that the sizes, locations, and group patterns of the various apertures on the plate system 52 can offer unlimited ways by which the flow characteristics upstream of and in the combustion chamber 34 can be controlled.

Figure 6:
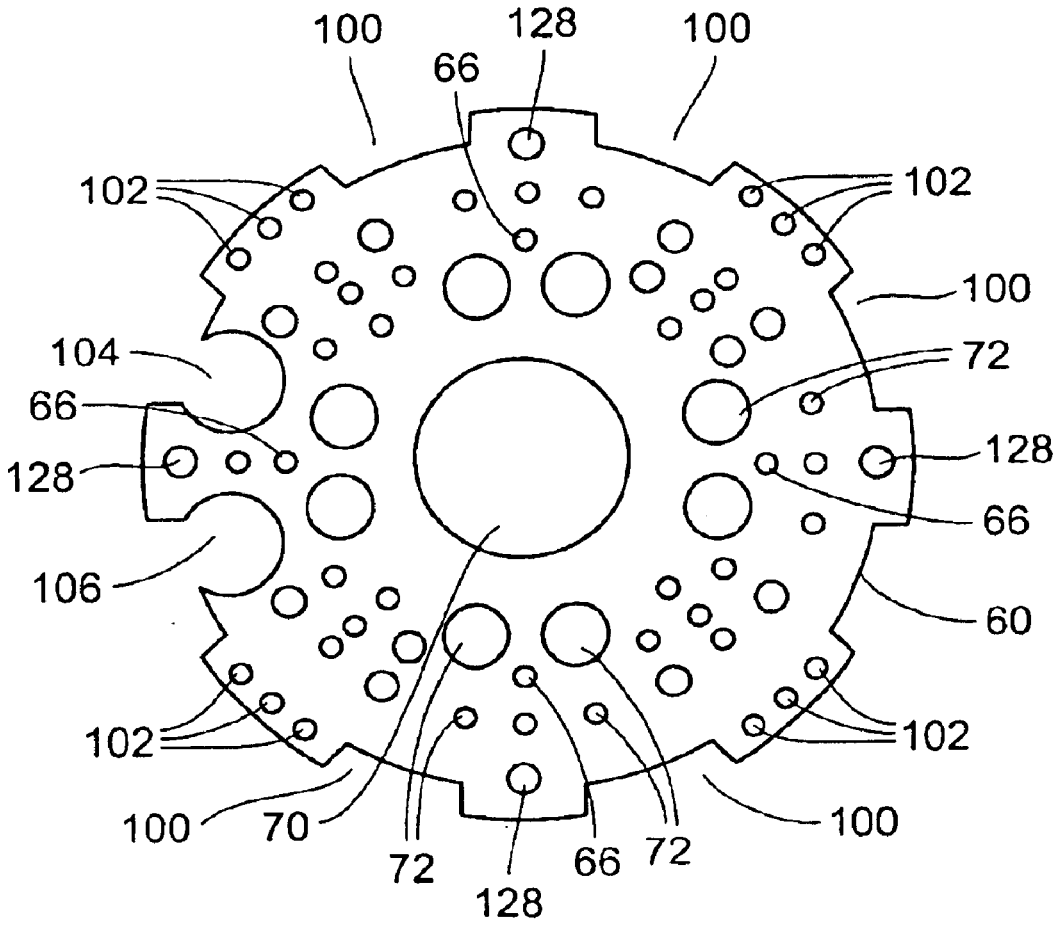
FIG. 6 is a top view of a base plate of a first disclosed example of a modular flame retention plate system constructed in accordance with the teachings of the present disclosure.

Referring to FIGS. 6–12, an example of the disclosed plate system 52 is shown, where similar parts as those described in the foregoing have the same reference numbers. Referring to FIG. 6, the base plate 60 includes the center aperture 70 and the plurality of air flow apertures 72. The base plate 60 also includes a plurality of arc shaped air flow slots 100 distributed along its perimeter and a plurality of air flow apertures 102 disposed along its perimeter between each of the arc shaped air flow slots 100. The base plate 60 further includes a flame sensing rod aperture 104 and an ignition spark rod aperture 106. Each of the intermediate plate 62 and the top plate 64 also includes a flame sensing rod aperture 104 and the ignition spark rod aperture 106, so that the flame sensing rod 42 and the ignition spark rod assembly 46 can pass through the retention plate system 52 into the combustion chamber 34, as shown best in FIG. 1.

Figure 7:
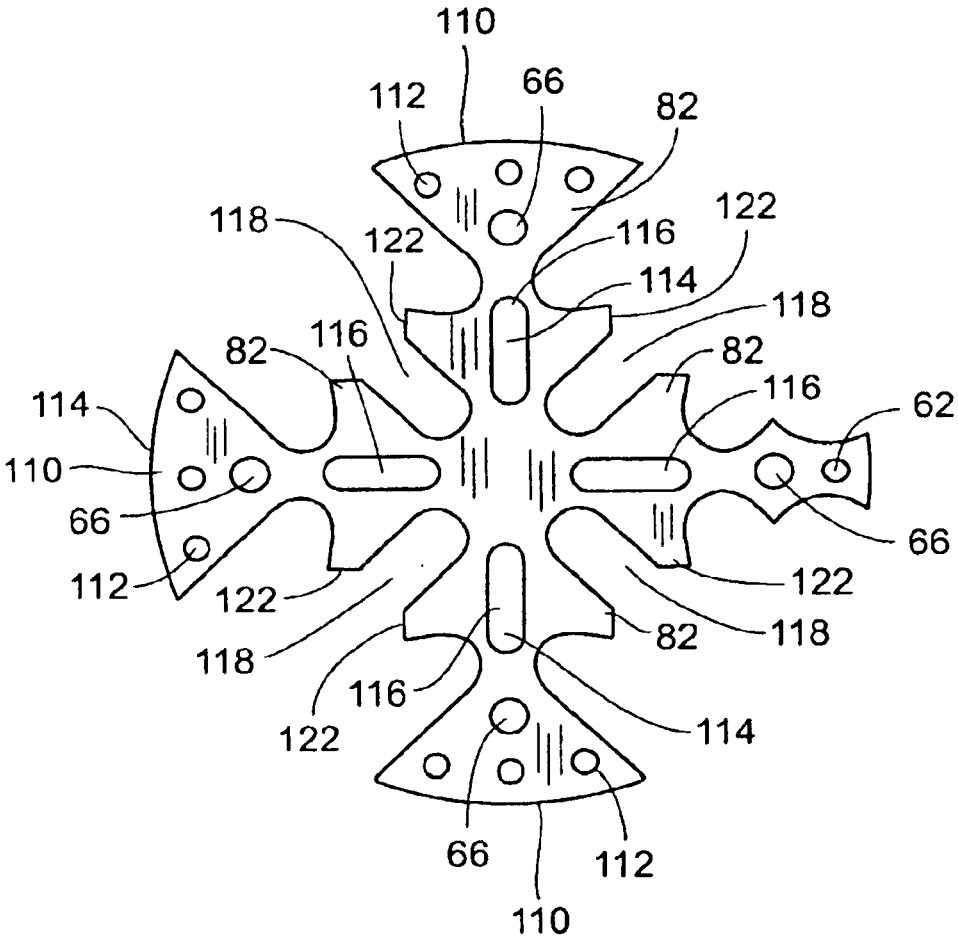
FIG. 7 is a top view of an intermediate plate of a first disclosed example of a modular flame retention plate system constructed in accordance with the teachings of the present disclosure.
Figure 10:
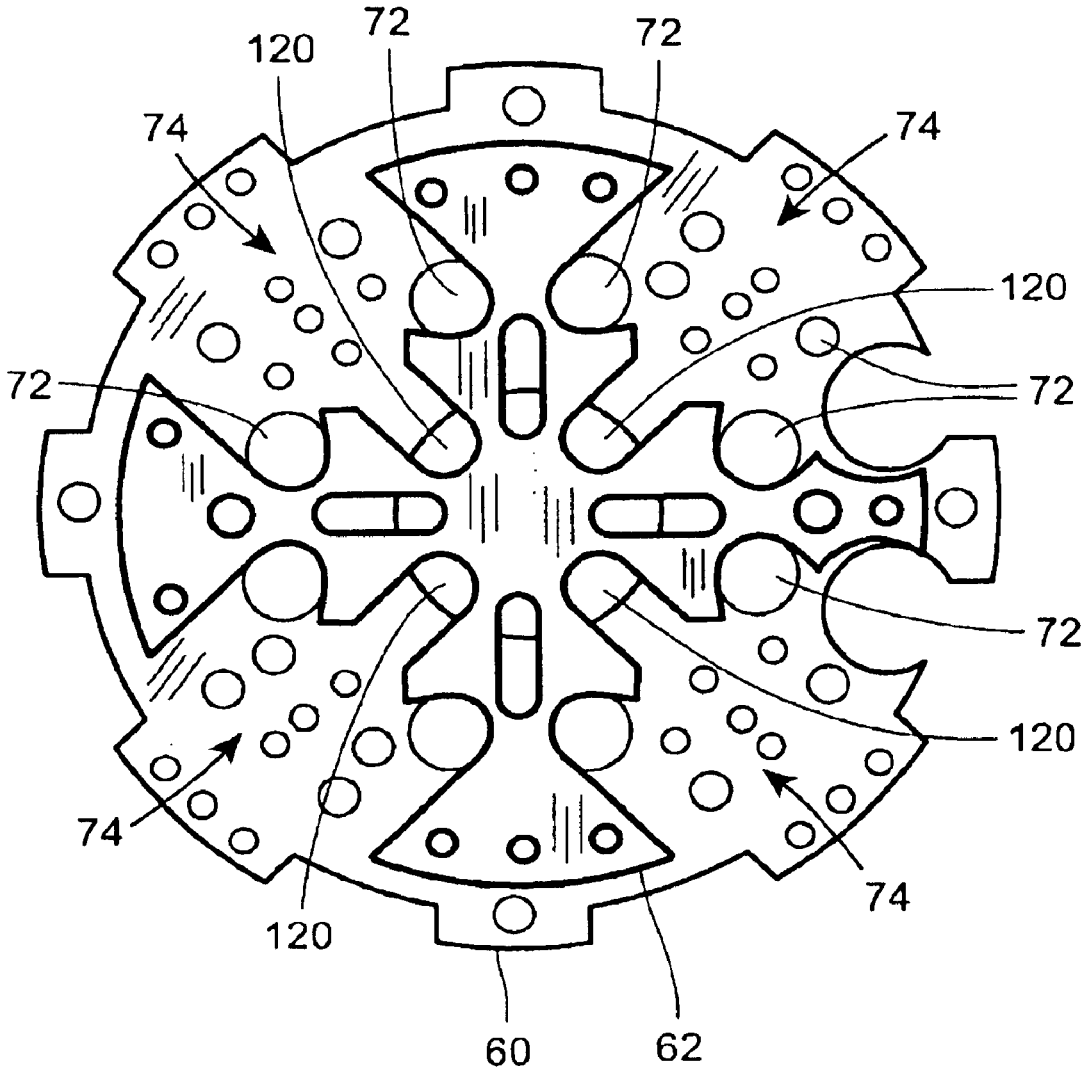
FIG. 10 is a top view of the intermediate plate of FIG. 7 mounted on the base plate of FIG. 6.

Referring to FIGS. 7 and 10, the intermediate plate 62 in the depicted embodiment includes four spokes 82 having enlarged end portions 110, which include a plurality of air flow apertures 112. Each spoke further includes a slot 114 that extends radially outward from the hub 80 and terminates at the enlarged portion 110. Each slot 114 includes a slit 116 that is nearly transverse to the general direction of the slot 114. Because the angular space between each pair of adjacent spokes 82 defines an interaction chamber 74, in the disclosed example, the retention plate system 52 includes four interaction chambers 74. Each spoke 82 has an outwardly flared shape as it extends radially from the hub 80. Accordingly, each two adjacent spokes 80 define a radially extending hub aperture 118 for directing combustion gas from the center aperture 70 of the base plate 60 to a corresponding interaction chamber 74.

Figure 8:
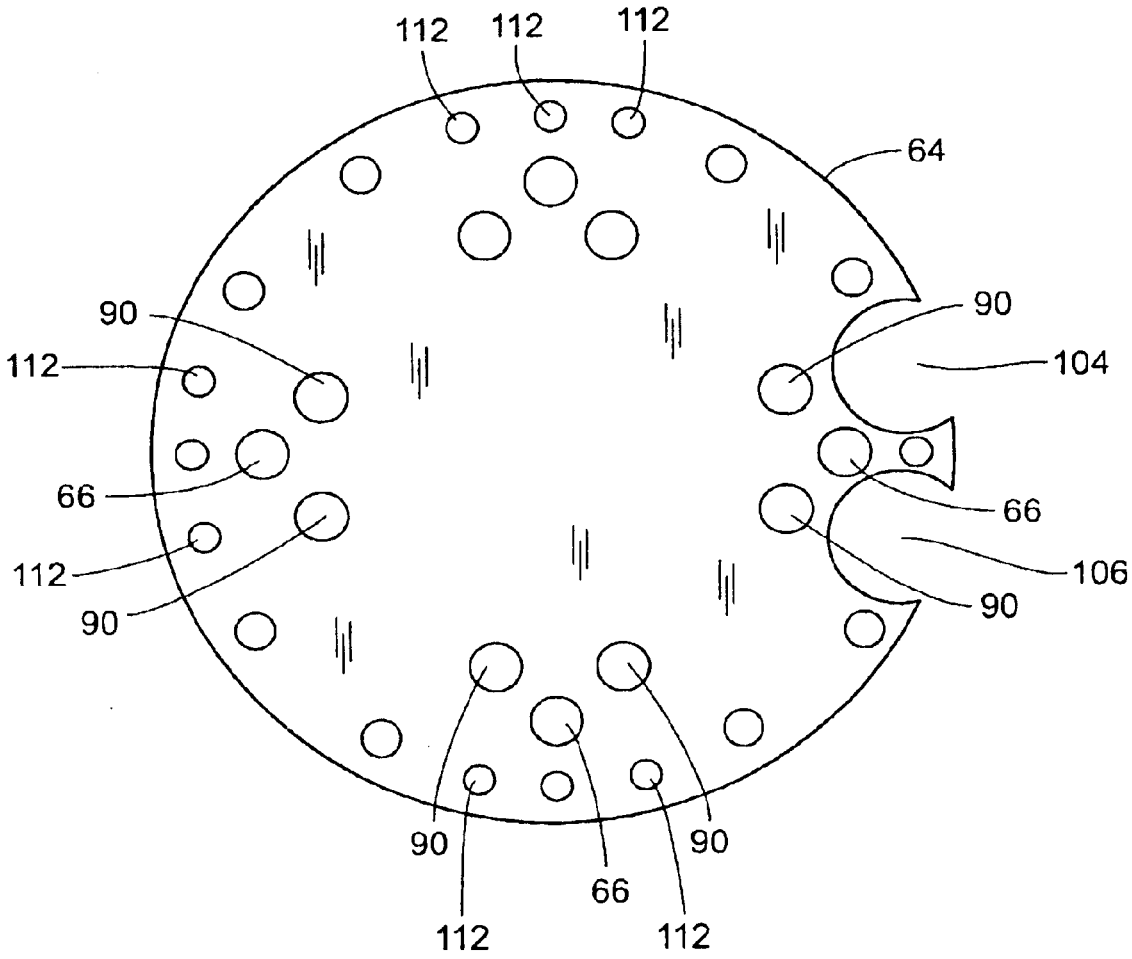
FIG. 8 is a top view of a top plate of a first disclosed example of a modular flame retention plate system constructed in accordance with the teachings of the present disclosure.
Figure 9:
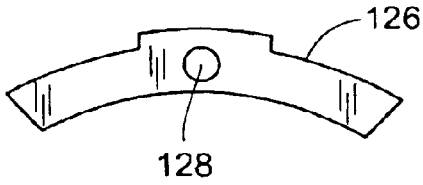
FIG. 9 is a top view of an arc shaped tab of a first disclosed example of a modular flame retention plate system constructed in accordance with the teachings of the present disclosure.
Figure 11:
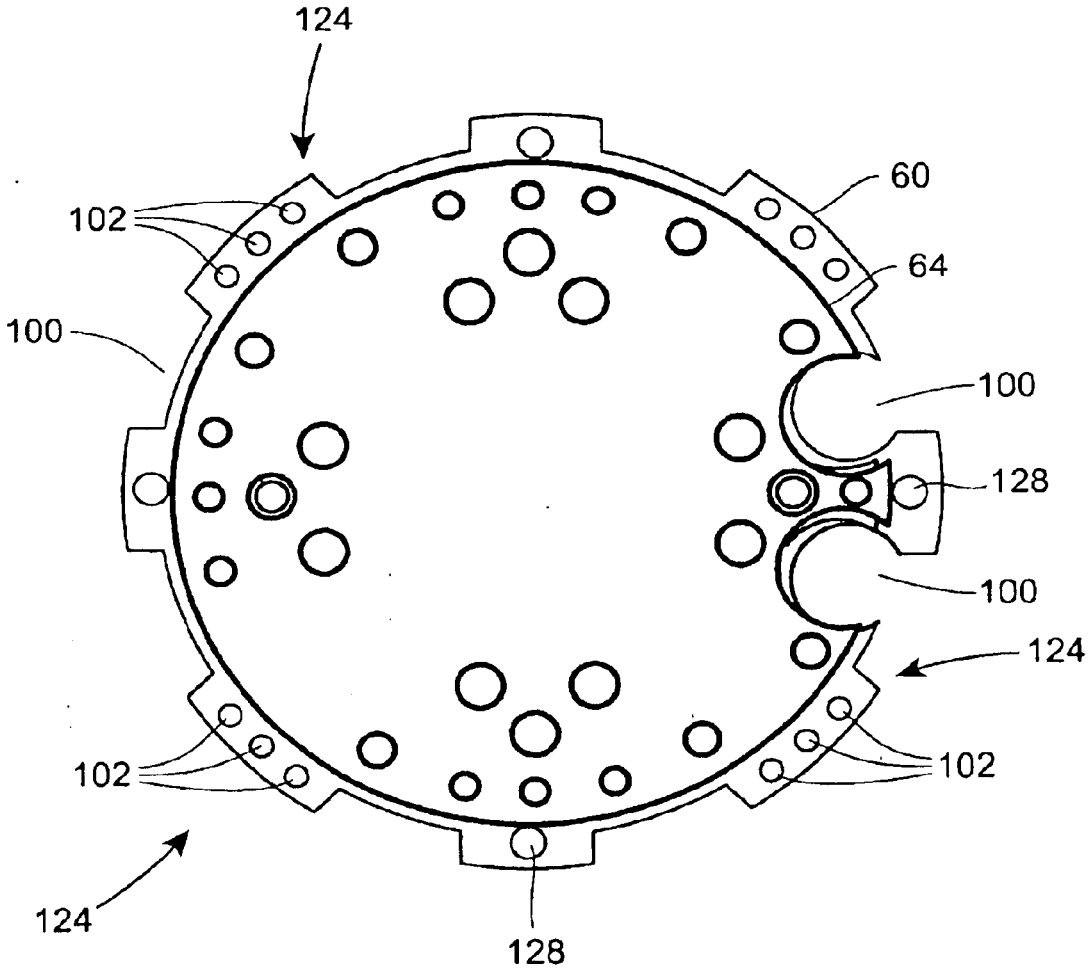
FIG. 11 is a top view of the top plate of FIG. 8 mounted on the intermediate plate of FIG. 10.

Referring to FIGS. 8 and 11, the flow apertures 90 of the top plate 64 are distributed more near the perimeter of the top plate 64 than near its center. Accordingly, when the top plate 64 is mounted on the intermediate plate 62, the flow apertures 90 of the top plate 64 only communicate with the interaction chambers 74.

Referring to FIG. 11, the intermediate plate 62 is shown to be mounted on the base plate 60, and the top plate 64 is shown to be mounted on the intermediate plate 62. To provide proper alignment of the base plate 60, the intermediate plate 62, and the top plate 64, the mounting apertures 66 of all three plates are aligned as shown in such a way so that the flame rod apertures 104 and the ignition spark rod apertures 106 of the plates are also aligned. The plates are then secured together by fasteners 68 that are housed in the mounting apertures 66.

Referring to FIG. 10, when the intermediate plate 62 and the base plate 60 are properly aligned, the hub 80 and portions of the spokes 82 cover the center aperture 70 of the base plate 60. Accordingly, combustion gas flowing through the center aperture 70 is blocked by the hub 80 and is only allowed passage through the slots 114 of the spokes 82 and the hub apertures 118. However, with reference to FIG. 11, because the top plate 64 covers the intermediate plate 62, except for the enlarged portions 110 of the spokes 82 and the interaction chambers 74, the flow of combustion gas is diverted from its original direction along the burner tube 26 to a radial direction relative to the center aperture 70.

As shown in FIG. 10, the combustion gas enters and flows through the slots 114 and the hub apertures 118 from the center aperture 70 of the base plate 60. As shown by arrow 120, each of the hub apertures 118 directs combustion gas from the center aperture 70 to a corresponding interaction chamber 74. To widely distribute the combustion gas in the interaction chamber 74, openings 122 of the radial hub apertures 118 are flared outward. Each slot 114 directs combustion gas to a corresponding interaction chamber 74 through a corresponding slit 116. The interaction chamber 74 receives combustion air through the combustion air apertures 72 of the base plate 60. Accordingly, the combustion gas that is delivered to the interaction chamber 74 by the slots 114 and the hub apertures 118 interacts with the combustion air from the air apertures 72 of the base plate 60.

As shown in FIG. 11, the intermediate plate 62 and the top plate 64 of the disclosed example are smaller than the base plate 60. Accordingly, the intermediate plate 62 and the top plate 64 do not completely cover the base plate 60 when mounted thereon. Additionally, each of the interaction chambers 74 opens over a perimeter region 124 of the base plate 60, thus causing some of the mixed gases (i.e., combustion air and combustion gas mixture) from each interaction chamber 74 to flow to the corresponding perimeter region 124. The mixed gases interact with combustion air flowing through the base plate 60 from the arc shaped slots 100 and the air flow apertures 102, and flow downstream into the combustion chamber 34.

The arc shaped slots 100 and air flow apertures 102 can vary in number, size, and distribution pattern so as to provide a desired air flow characteristic. One function of the air flow apertures 102 is to stabilize the flame that forms in the combustion chamber 34. One of ordinary skill in the art will appreciate that such flame stabilization is directly related to the noise generated by the burning process.

Figure 12:
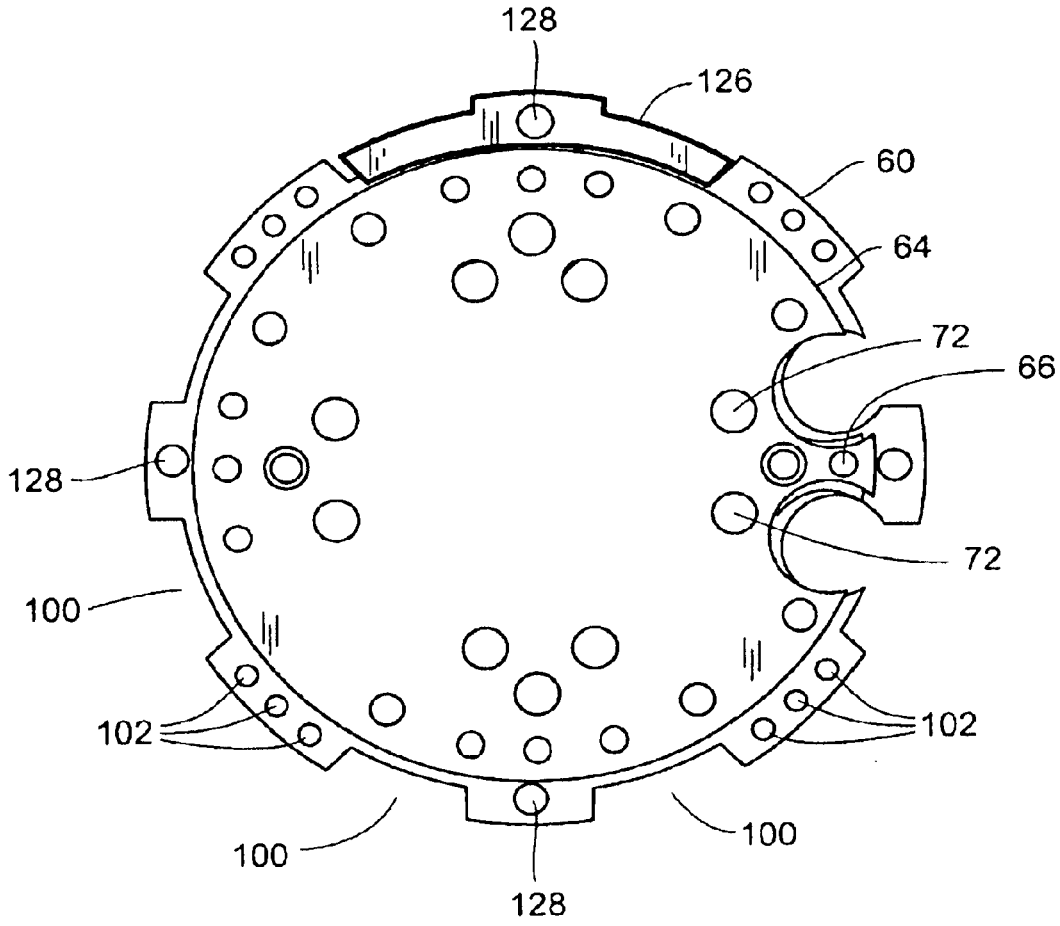
FIG. 12 is a top view of the arc shaped tab of FIG. 9 mounted on the modular flame retention plate system of FIG. 11.

In certain burner applications, it may be necessary to reduce BTU output of the burner by reducing the combustion air flowing into the combustion chamber 34. To reduce the air flowing into the combustion chamber 34, the plate system 52 of the disclosed example also includes a number of optional arc shaped tabs 126 that can be attached to the perimeter portion 124 of the plate system 52. Referring to FIG. 12, one such tab 126 is shown attached to the plate system 52. The tab 126 is shown to be blocking the air flow from two arc shaped slots 100 and a group of air flow apertures 102 that are between the two arc shaped slots 100. The tab 128 includes a mounting aperture 128, which can be aligned with a number of corresponding mounting apertures 128 on the perimeter portion 124 of the base plate 60 to receive fasteners 130 (shown in FIG. 2 only). However, one of ordinary skill in the art will appreciate that larger tabs 126 (not shown) can be provided that can block more or even all of the arc shaped slots 100 and the air flow apertures 102. One such large tab 126, which fully covers the arc shaped slots 100 and the air flow apertures 102 is shown in FIG. 2. Additionally, more than one tab 126 can be mounted to the plate system 52 to cover non-contiguous perimeter portions of the plate system 52. The tabs 126 can provide full burner efficiency in the entire operating range of the burner 20, or if the burner 20 is operating at less than full capacity, by controlling the velocity of combustion air.

In operation, the apertures 90 of the top plate 64 deliver a mixture of combustion air and combustion gas from each interaction chamber 74 into the combustion chamber 34. The ignition spark rod assembly 46 ignites the mixture and a primary flame is formed downstream of each aperture 90. Additionally, the mixture of combustion gas and combustion air entering the combustion chamber 34 from the perimeter regions 124 are ignited by the primary flame to form a secondary flame and more contiguous flame that blankets the discrete flames generated by the apertures 90 of the top plate 64.

One of ordinary skill in the art will appreciate from the foregoing that the plate system 52 provides controlled mixing of the combustion air and the combustion gas and a controlled delivery thereof to the combustion chamber 34. Such controlled mixing and delivery can provide a wide range of BTU outputs for the burner 20, and provide flame stabilization, which reduces burner noise. Furthermore, the plate system 52 is modular, and therefore, highly customizable for use in various types of burners. Additionally, the plate system 52 facilitates controlled mixing and delivery of the combustion air and the combustion gas in a very small cross section of the burner tube 26. Accordingly, burners using the disclosed plate system 52 can have short burner tubes 26, and therefore, can be used in applications where space accommodations for the burner are minimal.

Persons of ordinary skill in the art will appreciate that, although the teachings of the invention have been illustrated in connection with certain embodiments, there is no intent to limit the invention to such embodiments. On the contrary, the intention of this application is to cover all modifications and embodiments fairly falling within the scope of the teachings of the invention.

What is claimed is:

1. A burner assembly comprising:

a generally cylindrical burner tube adapted to supply combustion air to a combustion chamber downstream of the burner tube;

a gas supply conduit disposed in the burner tube adapted to supply combustion gas to the combustion chamber; and a burner head assembly disposed in the burner tube upstream of the combustion chamber, the burner head assembly including a plurality of flame retention plates removably mounted thereto, wherein the flame retention plates include a base plate, a top plate, and at least one intermediate plate disposed between the base plate and the top plate, the intermediate plate including a center hub and a plurality of spokes extending from the hub, wherein each pair of adjacent spokes, the base plate, and the top plate define an interaction chamber.

2. The burner assembly of claim 1, wherein the hub includes hub apertures communicating with the interaction chambers.

3. The burner assembly of claim 1, wherein each interaction chamber communicates with the burner tube by a plurality of apertures in the base plate.

4. The burner assembly of claim 1, wherein each interaction chamber communicates with the combustion chamber by a plurality of apertures in the top plate.

5. A modular flame retention plate system for use in a burner having a cylindrical burner tube, the modular plate retention plate system comprising:

a base plate disposed near an end portion of the burner tube and having a plurality of combustion air flow and combustion gas flow apertures;

at least one intermediate plate mounted on and downstream of the base plate and including a plurality of combustion air flow and combustion gas flow apertures; and a top plate mounted on and downstream of the intermediate plate and including a plurality of combustion air flow and combustion gas flow apertures, wherein the intermediate plate includes a center hub and a plurality of spokes extending from the hub, wherein each pair of adjacent spokes, the base plate, and the top plate define an interaction chamber.

6. The modular flame retention plate system of claim 5, wherein each spoke includes at least one slot having a slit connecting the slot to an adjacent interaction chamber.

7. The modular flame retention plate system of claim 5, wherein each spoke includes an enlarged end portion having a plurality of apertures.

8. The modular flame retention plate system of claim 7, wherein combustion air is delivered to a combustion chamber through the plurality of apertures disposed in the enlarged end portion of each spoke.

9. The modular flame retention plate system of claim 5, the hub including hub apertures communicating with the interaction chambers.

10. The modular flame retention plate system of claim 5, wherein the base plate includes a plurality of air flow apertures disposed about a perimeter thereof.

11. The modular flame retention plate system of claim 5, further comprising a plurality of changeable tabs mountable on a perimeter of the base plate, the base plate including a plurality of air flow apertures disposed about the perimeter thereof.

12. A method of controlling delivery of combustion air and combustion gas into a combustion chamber of a burner, the method comprising:

providing a plurality of interaction chambers upstream of the combustion chamber, the interaction chambers being generally bound by a flame retention base plate, at least one flame retention intermediate plate, and a flame retention top plate, the at least one flame retention intermediate plate being disposed between the flame retention base plate and the flame retention top plate, the shape of each interaction chamber being generally defined by the at least one flame intermediate plate;

providing combustion air to each interaction chamber through a plurality of air flow apertures disposed in the base plate;

distributing combustion gas into each of the interaction chambers by a hub of the intermediate plate, and a plurality of spokes extending outward from the hub, the hub and the spokes receiving gas from at least one gas aperture disposed in the base plate; and delivering combustion air and combustion gas from each interaction chamber into the combustion chamber and through plurality of gas and air flow apertures disposed in the top plate.

13. The method of claim 12, wherein the distributing of combustion gas into each interaction chamber is at least through a hub aperture communicating between the gas aperture of the base plate and the interaction chambers.

14. The method of claim 12, wherein the distributing of combustion gas into each interaction chamber is through a slot disposed in at least one of the spokes adjacent the interaction chamber, the slot communicating between the gas aperture of the base plate and the interaction chamber.

15. The method of claim 12, the slot communicating with an adjacent interaction chamber by a slit connecting the slot to the interaction chamber.

16. The method of claim 12, further comprising delivering combustion air into the combustion chamber through a plurality of apertures disposed in an enlarged end portion of each spoke.

17. The method of claim 12, further comprising delivering combustion air into the combustion chamber through a plurality air flow apertures disposed about a perimeter of the base plate.

* * * * *